US010590684B2

(12) United States Patent
Elizalde Salegui

(10) Patent No.: US 10,590,684 B2
(45) Date of Patent: Mar. 17, 2020

(54) DOOR DEVICE

(71) Applicant: PUERTAS Y SISTEMAS ANTI INUNDACIONES S.L., Zizur Mayor Navarra (ES)

(72) Inventor: Lucas Mª Elizalde Salegui, Pamplona (ES)

(73) Assignee: PUERTAS Y SISTEMAS ANTI INUNDACIONES S.L., Zizur Mayor Navarra (ES)

( * ) Notice: Subject to any disclaimer, the term of this patent is extended or adjusted under 35 U.S.C. 154(b) by 37 days.

(21) Appl. No.: 16/071,689

(22) PCT Filed: Jan. 20, 2017

(86) PCT No.: PCT/EP2017/051165
§ 371 (c)(1),
(2) Date: Jul. 20, 2018

(87) PCT Pub. No.: WO2017/125537
PCT Pub. Date: Jul. 27, 2017

(65) Prior Publication Data

US 2019/0032379 A1 Jan. 31, 2019

(30) Foreign Application Priority Data

Jan. 21, 2016 (EP) ..... 16382024

(51) Int. Cl.
*E06B 7/18* (2006.01)
*E05C 9/16* (2006.01)
(Continued)

(52) U.S. Cl.
CPC ..... *E05C 19/001* (2013.01); *E05C 9/16* (2013.01); *E06B 7/18* (2013.01); *E06B 2009/007* (2013.01)

(58) Field of Classification Search
CPC ... E05C 9/16; E05C 9/06; E05C 9/063; E05C 19/001; E06B 7/18; E05B 65/0075
See application file for complete search history.

(56) References Cited

U.S. PATENT DOCUMENTS 473,800 A 4/1892 Van Broek
595,128 A 12/1897 McArthur
(Continued)

FOREIGN PATENT DOCUMENTS

EP 0388334 A1 9/1990
GB 846642 A 8/1960

OTHER PUBLICATIONS

International Search Report, dated Mar. 27, 2017.

*Primary Examiner* — Justin B Rephann
(74) *Attorney, Agent, or Firm* — Tristan A. Fuierer; Olive Law Group, PLLC

(57) ABSTRACT

The invention provides a door device (1) adapted to provide a watertight condition against an external surface, the door device (1) comprising a main support surface (2), a main spar (10), first and second main closing elements (3, 4), first, second, third and fourth connecting elements (5, 6, 7, 8), primary guiding elements (91, 92), a transversal element (11) comprising an auxiliary closing wedge (111) and secondary guiding elements (93, 94), wherein along the movement of the main spar (10) between a first inactive position and a second watertight position, the movement of each second connecting element (6) is limited by the corresponding primary guiding element (91, 92) to the direction of said primary guiding element (91, 92), making the first and second main closing elements (3, 4) exit a main area (2*a*). When the main spar (10) is in the watertight position, the watertight gap is equal to the length of the watertight side of
(Continued)

the auxiliary closing wedge (111). The invention also provides a watertight system and a method.

17 Claims, 11 Drawing Sheets

(51) Int. Cl.
*E05C 19/00* (2006.01)
*E06B 9/00* (2006.01)

(56) References Cited

U.S. PATENT DOCUMENTS 1,345,967 A 7/1920 Smelser
2,295,324 A * 9/1942 Arthur ..... E05C 9/06 292/48
2,500,000 A * 3/1950 Lambert ..... E05C 9/06 292/335
3,059,287 A 10/1962 Baruch et al.
4,180,943 A * 1/1980 Smith ..... B64C 1/1407 244/129.5
4,534,192 A * 8/1985 Harshbarger ..... E05B 63/20 109/59 R
4,754,715 A * 7/1988 Squires ..... E05B 65/0075 109/59 T
4,971,369 A 11/1990 Moriya
5,333,920 A * 8/1994 de Rover ..... B63B 43/32 292/48
6,101,764 A * 8/2000 Guy-Paul ..... B63B 43/32 292/196
6,105,313 A * 8/2000 Holloway ..... E06B 7/18 49/318
6,446,393 B1 * 9/2002 Marston, Sr. ..... B63B 19/24 292/196
2007/0151162 A1 * 7/2007 Thielmann ..... E05C 9/063 49/395
2010/0242810 A1 * 9/2010 Todd ..... E05B 65/0075 109/59 R
2010/0327716 A1 * 12/2010 Li ..... E05B 65/006 312/294
2011/0083591 A1 * 4/2011 Stepp ..... E05B 65/0075 109/64
2011/0174025 A1 * 7/2011 Rasmussen ..... E05B 47/0673 70/91
2016/0060918 A1 * 3/2016 Garrett ..... E05C 5/04 109/64

* cited by examiner

DOOR DEVICE

CROSS-REFERENCE TO RELATED APPLICATIONS

This application is filed under the provisions of 35 U.S.C. § 371 and claims the priority of International Patent Application No. PCT/EP2017/051165 filed on 20 Jan. 2017 entitled "DOOR DEVICE" in the name of Lucas M[a] ELIZALDE SALEGUI, et al., which claims priority to European Patent Application No. 16382024.4, filed on 21 Jan. 2016, both of which are hereby incorporated by reference herein in their entirety.

TECHNICAL FIELD OF THE INVENTION

The present invention is related to the field of doors, in particular to the field of watertight doors.

BACKGROUND OF THE INVENTION

Frequent floods may cause big damage in buildings and other facilities. Watertight doors are known for submarines and other naval crafts. These watertight doors work by exerting pressure to the door against a frame which outstands from the floor, taking advantage of the closing operation of the door against the frame to achieve a watertight closure.

However, these doors containing an outstanding frame are not suitable for being used in buildings or houses, where accessibility is an asset.

SUMMARY OF THE INVENTION

The present invention provides a solution for the aforementioned problems by a door device according to claim 1, a door according to claim 11, a watertight system according to claim 12 and a method according to claim 15. The dependent claims define preferred embodiments of the invention.

According to a first aspect, the invention provides a door device adapted to provide a watertight condition against an external surface, the door device comprising:

a main support surface, defining a main area;

a main spar adapted to be moved in an activation direction between an inactive position and a watertight position;

a first main closing element comprising a wedged end with a first closure point located in an acute vertex of said wedged end, a second main closing element comprising a wedged end with a second closure point located in an acute vertex of said wedged end, said first and second closure points defining a closure gap, which is the distance between said first and second closure points;

first connecting elements, each having a first end and a second end, each first connecting element being hingeably attached in the first end to the main spar;

second connecting elements, each having a first end and a second end, each second connecting element being hingeably attached in the first end to the second end of one first connecting element and being hingeably attached in the second end to the first main closing element;

third connecting elements, each having a first end and a second end, each third connecting element being hingeably attached in the first end to the main spar;

fourth connecting elements, each having a first end and a second end, each fourth connecting element being hingeably attached in the first end to the second end of one third connecting element and being hingeably attached in the second end to the second main closing element;

a plurality of primary guiding elements, each one being attached to the main support surface, in such a way that each one of the second connecting elements is in contact with one of a first group of primary guiding elements which are oriented forming a first primary guiding angle respect to the activation direction in clockwise direction, and each one of the fourth connecting elements is in contact with one of a second group of primary guiding elements, which are oriented forming a second primary guiding angle respect to the activation direction in counterclockwise direction;

a transversal element comprising an auxiliary closing wedge with sides, two of the sides forming first and second wedge angles respectively with respect to the activation direction and other side being the ground side;

a first secondary guiding element, and a second secondary guiding element, the secondary guiding elements being adapted to guide the transversal element, the tangent to each point of the first secondary guiding element forming a first secondary guiding angle respect to the activation direction in counterclockwise direction and the tangent to each point of the second secondary guiding element forming a second secondary guiding angle respect to the activation direction in clockwise direction; wherein in the inactive position of the main spar, the first and second main closing elements are located within the main area;

along the movement of the main spar between the inactive position and the watertight position, the movement of each second connecting element is limited by one of the first group of primary guiding elements to the direction of said primary guiding element and the movement of each fourth connecting element is limited by one of the second group of primary guiding elements to the direction of said primary guiding element, making the first and second main closing elements exit the main area;

when the main spar is in the watertight position, the closure gap is equal to the length of the ground side of the auxiliary closing wedge;

the secondary guiding elements are adapted to guide the transversal element so that the auxiliary closing wedge exits the main area to abut both the wedged end of the first main closing element, which forms a first closing angle with respect to the activation direction which is equal to the first wedge angle, and the wedged end of the second main closing element, which forms a second closing angle with respect to the activation direction which is equal to the second wedge angle; and the first secondary guiding angle is lower or equal than the first wedge angle and the second secondary guiding angle is lower or equal than the second wedge angle.

According to the invention, the watertight condition is provided by the movement of the first and second main closing elements and the auxiliary closing wedge out of the main area, thus allowing abutment of these elements against an external surface. Advantageously, this door device does not need a frame which outstands from the floor to provide a watertight condition and therefore, does not create an accessibility obstacle.

In a particular embodiment, the first primary guiding angle is equal to the second primary guiding angle, the first wedge angle is equal to the second wedge angle and the first secondary guiding angle is equal to the second secondary guiding angle.

In an embodiment, the first secondary guiding element and the second secondary guiding element are substantially linear.

In a particular embodiment, the first secondary guiding element is attached to the first main closing element, and the second secondary guiding element is attached to the second main closing element, so that the secondary guiding elements guide the transversal element when the main spar moves between the inactive position and the watertight position.

Advantageously, this embodiment has the elements intended to provide the watertight effect (i.e., the main closing elements and the auxiliary closing wedge) interconnected, in such a way that when one of these elements moves, the other ones move accordingly, so it is enough to cause one of these elements to move to have the rest of these elements moved.

In a particular embodiment, the secondary guiding elements are attached to the main support surface, the first secondary guiding angle and the second secondary guiding angle equal 0 and the door device further comprises a first handling element adapted to move the transversal element to a position wherein the auxiliary closing wedge abuts both the wedged end of the first main closing element and the wedged end of the second main closing element.

Advantageously, this embodiment allows the manual activation of the elements intended to provide the watertight effect. The transversal element may be moved independently from the main closing elements to provide a simpler device.

In a particular embodiment, the door device further comprises a second handling element adapted to move the main spar between the inactive position and the watertight position.

This particular embodiment makes the door device be easily installed in a common door which has the same dimensions of the main area.

In a particular embodiment, the first and second main closing elements and at least part of the auxiliary closing wedge are made of a waterproof material.

In a particular embodiment, the first and second main closing elements are substantially L-shaped, each comprising a longer arm and a shorter arm; the longer arms being arranged substantially parallel to each other and the shorter arms being oriented towards each other.

In a particular embodiment, the main closing elements are placed such that when the main spar is in the inactive position, the longer arms and the shorter arms are located in the edges of the main area, which is rectangular.

In a particular embodiment, the main closing elements and the auxiliary closing wedge comprise sealing elements.

In a particular embodiment, the door device further comprises a secondary support surface substantially parallel to the main support surface, wherein the main spar, the first, second, third and fourth connecting elements, the primary guiding elements and the first and second secondary guiding elements are placed between the main support surface and the secondary support surface. In a preferred embodiment, the main support surface and the secondary support surface are attached to one another by means of at least one stiffening element placed between the main support surface and the secondary support surface. The stiffening element, such as a rib, provides increased stiffness to the door device and keeps the main support surface and the secondary support surface spaced from one another.

The main and/or the secondary support surfaces can be each embodied by means of a plate.

In a second inventive aspect, the invention provides a door comprising a door device according to the first inventive aspect.

The door device according to the invention may be included as an internal component of a door during the manufacturing process of the door, such that the door device is embedded within the door itself. In this case, the door is provided with at least one peripheral opening allowing the pass of the first and second main closing elements and of the auxiliary closing wedge when the main spar is moved from the inactive position to the watertight position.

Alternatively, the door device of the invention may be coupled to an already manufactured door. In an embodiment the door device is coupled to the door such that the main spar, the first, second, third and fourth connecting elements, the primary guiding elements and the first and second secondary guiding elements are placed between a surface of the door and the main support surface of the door device. Preferably, the main support surface of the door device is attached to the surface of the door by means of at least one rib placed between said surface of the door and the main support surface of the door device. In another embodiment, a door device comprising a main support surface and a secondary support surface is coupled to a door by coupling one of the main or secondary support surfaces to a surface of the door.

In a third inventive aspect, the invention provides a watertight system comprising a door device according to the first inventive aspect or a door according to the second inventive aspect and further comprising a slot assembly for providing watertightness, the slot assembly being adapted to receive at least partially the first and second main closing elements and the auxiliary closing wedge of the door device. In this embodiment the slot assembly provides the external surface against which the first and second main closing elements and the auxiliary closing wedge of the door device provide the watertight condition in the watertight position.

In a particular embodiment, the slot assembly comprises three slots, the first slot being adapted to receive at least part of the longer arm of one of the main closing elements, the second slot being adapted to receive at least part of the longer arm of other of the main closing elements and the third slot being adapted to receive at least part of the shorter arm of one of the main closing elements, at least part of the shorter arm of other of the main closing elements and at least part of the auxiliary closing wedge.

In a particular embodiment, the slot assembly is adapted to receive the first and second main closing elements and the auxiliary closing wedge of a door device, the slot assembly comprising third sealing elements arranged to contact the main closing elements and the closing wedge of the door device when the main spar is in its watertight position.

In a fourth inventive aspect, the invention provides a method for providing a watertight door, comprising the steps of providing a door device according to the first inventive aspect and attaching the door device to a door. In an embodiment the method comprises attaching the door device to the door such that the the main spar, the first, second, third and fourth connecting elements, the primary guiding elements and the first and second secondary guiding elements are placed between a surface of the door and the main support surface of the door device. Preferably, the main support surface of the door device is attached to the surface of the door by means of at least one rib placed between said surface of the door and the main support surface of the door device. In another embodiment, the door device comprises a main support surface and a secondary support surface and the method comprises attaching the door device to the door such that one of the main or secondary support surfaces is attached to a surface of the door.

All the features described in this specification, including the claims, description and drawings, can be combined in any combination, with the exception of combinations of such mutually exclusive features.

DESCRIPTION OF THE DRAWINGS

These and other characteristics and advantages of the invention will become clearly understood in view of the detailed description of the invention which becomes apparent from preferred embodiments of the invention, given just as an example and not being limited thereto, with reference to the drawings.

DETAILED DESCRIPTION OF THE INVENTION

Once the object of the invention has been outlined, specific non-limitative embodiments are described hereinafter.

Figure 1:
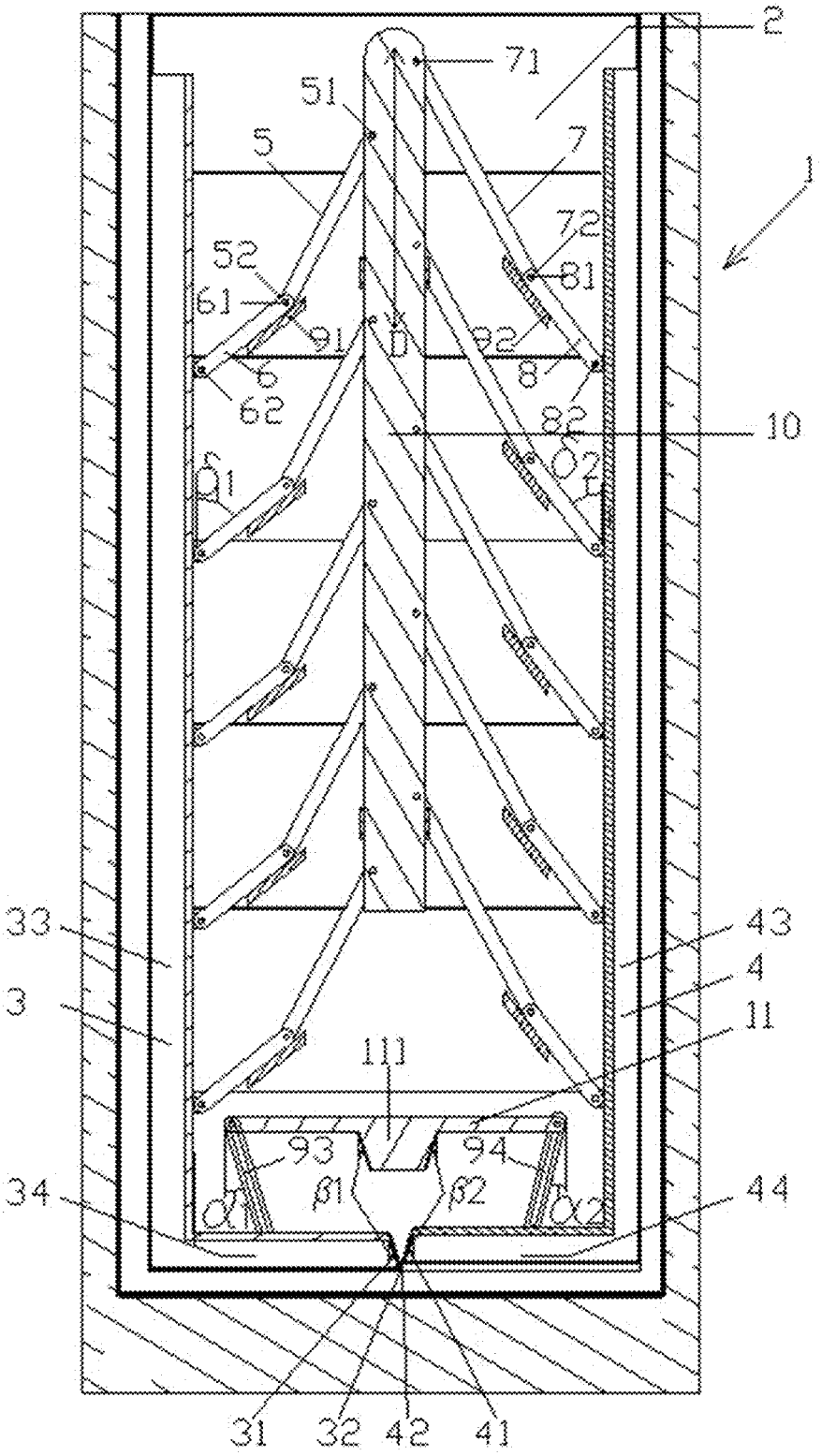
FIG. 1 This figure show an elevation view of a door device according to the invention, in an inactive position.

FIG. 1 shows an elevation view of a door device (1) according to the invention, in an inactive position. This door device (1) comprises:

a main support surface (2);

a main spar (10) adapted to be moved in an activation direction (D) between an inactive position and a watertight position;

a first main closing element (3) comprising a wedged end (31) with a first closure point (32) located in an acute vertex of said wedged end (31), a second main closing element (4) comprising a wedged end (41) with a second closure point (42) located in an acute vertex of said wedged end (41), said first and second closure points (32, 42) defining a closure gap, which is the distance between said first and second closure points (32, 42);

first connecting elements (5), each with a first end (51) and a second end (52), second connecting elements (6), each with a first end (61) and a second end (62), third connecting elements (7), each with a first end (71) and a second end (72);

fourth connecting elements (8), each with a first end (81) and a second end (82);

a first group of primary guiding elements (91) and a second group of primary guiding elements (92), a transversal element (11) comprising an auxiliary closing wedge (111); and a first secondary guiding element (93) being attached to the first main closing element (3) and a second secondary guiding element (94) being attached to the second main closing element (4).

Each first connecting element (5) is hingeably attached in the first end (51) to the main spar (10), and each second connecting element (6) is hingeably attached in the first end (61) to the second end (52) of one first connecting element (5) and is hingeably attached in the second end (62) to the first main closing element (3).

Each third connecting element (7) is hingeably attached in the first end (71) to the main spar (10), and each fourth connecting element (8) is hingeably attached in the first end (81) to the second end (72) of one third connecting element (7) and is hingeably attached in the second end (82) to the second main closing element (4).

Each primary guiding element (91, 92) is attached to the main support surface (2), in such a way that each one of the second connecting elements (6) is in contact with a primary guiding element (91) from the first group of primary guiding elements (91) and that each one of the fourth connecting elements (8) is in contact with a primary guiding element (92) from the second group of primary guiding elements (92).

The first group of primary guiding elements (91) are oriented forming a first primary guiding angle (δ1) respect to the activation direction (D) in clockwise direction.

The second group of primary guiding elements (92) are oriented forming a second primary guiding angle (δ2) respect to the activation direction (D) in counterclockwise direction.

This causes the system formed by the main spar (10), the first connecting elements (5) and the second connecting elements (6) to work like a crank-rod system: when the main spar (10) moves from an inactive position to a watertight position, the first connecting elements (5) transmit this movement to the second connecting elements (6), converting a displacement of the main spar (10) according to an activation direction (D) in a displacement of the first main closing element (3) attached to the second connecting elements (6) according to a direction defined by primary guiding elements (91). The system formed by the main spar (10), the third connecting elements (7) and the fourth connecting elements (8) work mutatis mutandis like another crank-rod system.

The auxiliary closing wedge (111) of the transversal element (11) comprises two sides forming first (β1) and second (β2) wedge angles, respectively, with respect to the activation direction (D) and a third side denoted as ground side (112). FIG. 6*b* shows a detailed view of the auxiliary closing wedge (111).

The secondary guiding elements (93, 94) are adapted to guide the transversal element (11). The first secondary guiding element (93) forms a first secondary guiding angle (α1) respect to the activation direction (D) in counterclockwise direction and the second secondary guiding element (94) forms a second secondary guiding angle (α2) respect to the activation direction (D) in clockwise direction.

Figure 2:
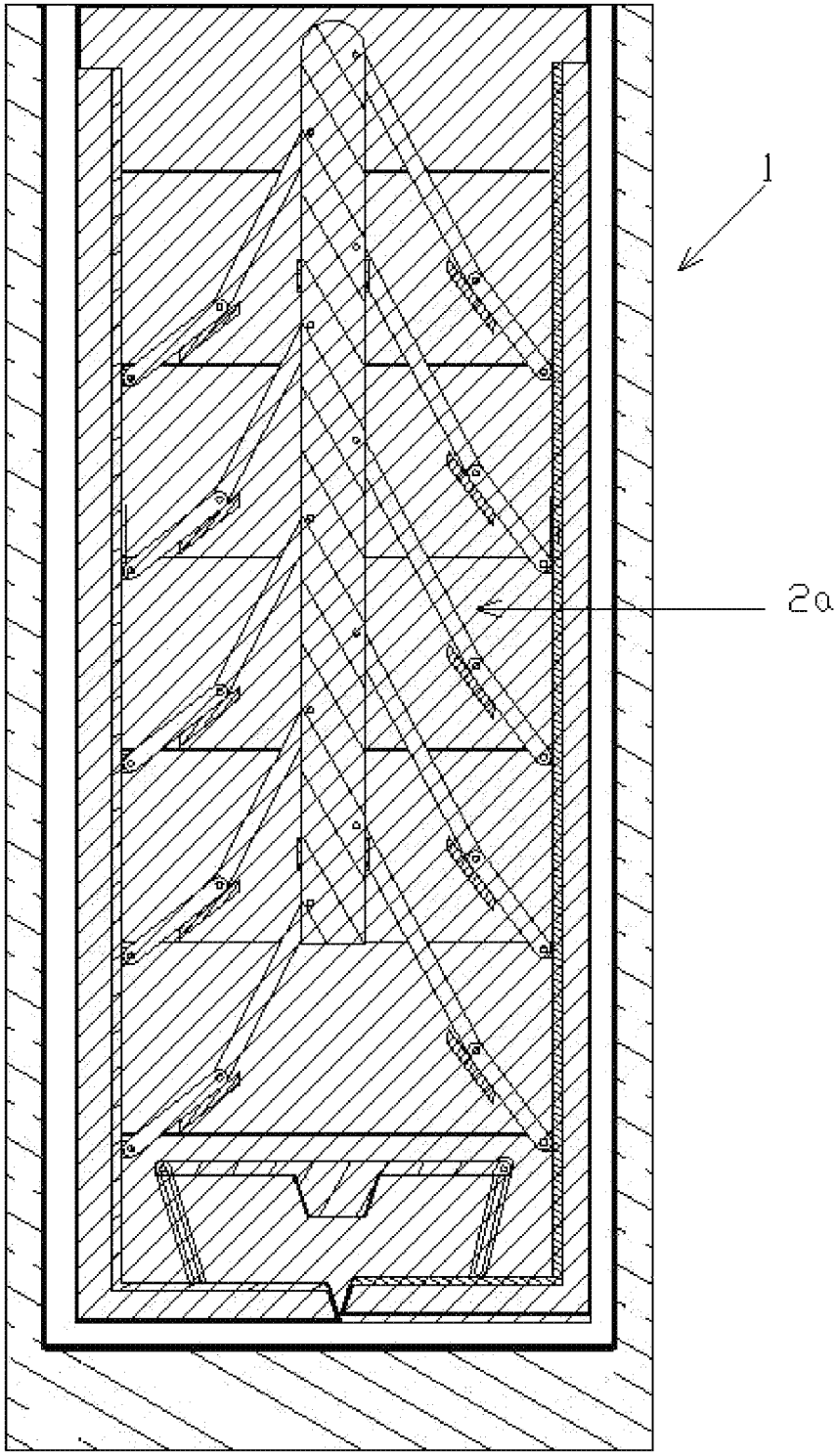
FIG. 2 This figure shows an elevation view of a door device according to the invention, showing the main area.

FIG. 2 identifies the main area (2*a*) which corresponds to the area occupied by the main support surface (2) of the door device (1).

Figure 3:
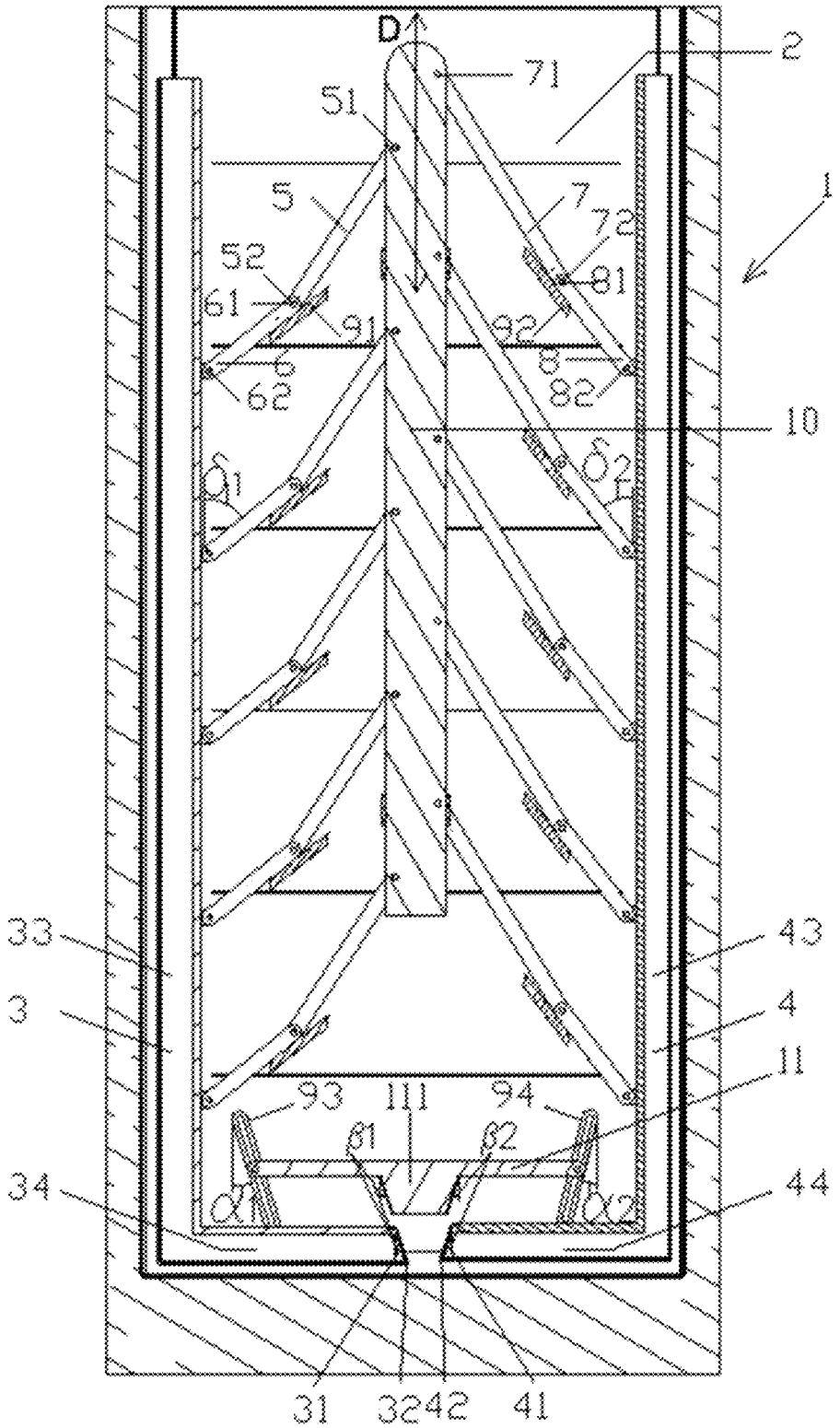
FIG. 3 This figure shows an elevation view of a door device according to the invention, in an intermediate position between the inactive position and the watertight position.
Figure 4:
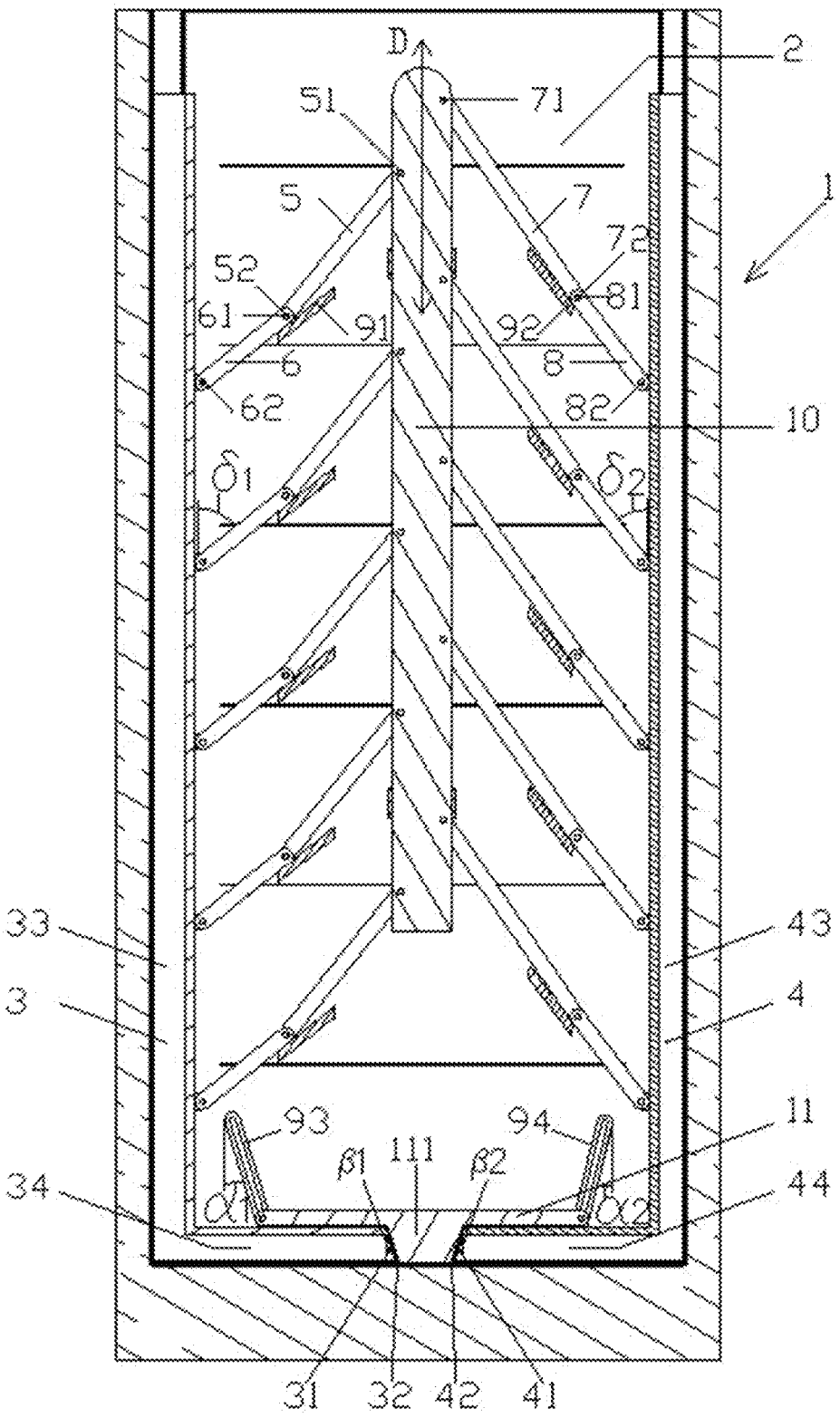
FIG. 4 This figure shows an elevation view of a door device according to the invention, in the watertight position.

FIGS. 3 and 4 show the door device (1) of FIG. 1 when the main spar (10) is being moved from the inactive position to the watertight position. FIG. 3 shows an intermediate position and FIG. 4 shows the door device (1) when the main spar (10) is in the watertight position.

In the inactive position of the main spar (10), the first and second main closing elements (3, 4) are located within the main area (2*a*). Along the movement of the main spar (10) between the inactive position and the watertight position, the movement of each second connecting element (6) is limited by the corresponding primary guiding element (91) of the first group to the direction of said primary guiding element (91), making at least part of the first main closing element (3) exit the main area (2*a*), in the sense that it becomes not totally comprised in the main area (2*a*). In the same way, the movement of each fourth connecting element (8) is limited by the corresponding primary guiding element (92) of the second group to the direction of said primary guiding element (92), making at least part of the second main closing element (4) exit the main area (2*a*). The movement of the first (3) and second (4) main closing elements out of the main area (2*a*) allows them to abut against an external surface, thus providing a watertight condition.

Further, along said movement of the main spar (10), the secondary guiding elements (93, 94) guide at least part of the auxiliary closing wedge (111) to exit the main area and to abut both the wedged end (31) of the first main closing element (3) and the wedged end (41) of the second main closing element (4). The wedged end (31) of the first main closing element (3) forms a first closing angle with respect to the activation direction (D) in the counterclockwise direction which is equal to the first wedge angle (β1). The wedged end (41) of the second main closing element (4) forms a second closing angle with respect to the activation direction (D) in the clockwise direction which is equal to the second wedge angle (β2). FIG. 6*b* shows a detailed view of the door device according to the embodiment of FIGS. 1 to 4, where the auxiliary closing wedge (111) and the wedged ends (31, 41) of the first (3) and second (4) main closing elements are shown.

When main closing elements (3, 4) move towards the watertight position, the closure gap increases, because the main closing elements (3, 4) move in different directions. One of the main closing elements (3) moves in the direction of the first group of primary guiding elements (91) and the other main closing element (4) moves in the direction of the second group of primary guiding elements (92).

The secondary guiding elements (93, 94) are adapted to guide the transversal element (11). This guidance is different from the guidance provided by the primary guiding elements (91, 92). In the case of this particular embodiment, one secondary guiding element (93, 94) is attached to each main closing element (3, 4). When the main closing elements (3, 4) move, the secondary guiding elements (93, 94) move with them and the closure gap increases. As the transversal element (11) has a constant length, it slides along the secondary guiding elements (93, 94) until part of it locates in the gap between the first and second main closing elements (3, 4).

To achieve a gapless arrangement between the first and second main closing elements (3, 4) and the auxiliary closing wedge (111), when the main spar (10) is in the watertight position, the closure gap is equal to the length of the ground side (112) of the auxiliary closing wedge (111). Further, to make the displacement of the transversal element (11) possible, the first secondary guiding angle (α1) is lower or equal than the first wedge angle (β1) and the second secondary guiding angle (α2) is lower or equal than the second wedge angle (β2).

Both first and second main closing elements (3, 4) are substantially L-shaped in this embodiment, each comprising a longer arm (33, 43) and a shorter arm (34, 44); the longer arms (33, 43) being arranged substantially parallel to each other and the shorter arms (34, 44) being oriented towards each other.

In this embodiment, the first and second main closing elements (3, 4) are placed such that when the main spar (10) is in the inactive position, the longer arms (33, 43) and the shorter arms (34, 44) are located in the edges of the main area, which in this embodiment is rectangular.

Figure 5A:
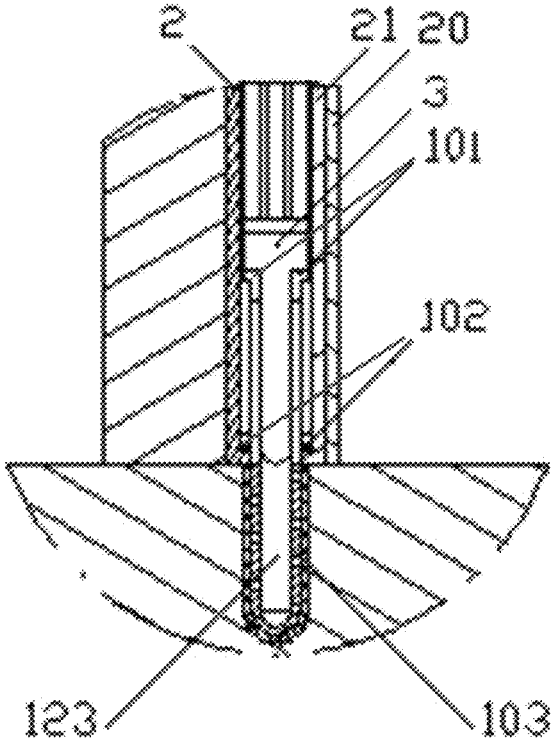
FIGS. 5*a*-5*b* These figures show a side sectional view of different details of the door device and a slot assembly according to an embodiment of the invention, both in the inactive and watertight positions.

FIG. 5*a* shows a detail of a side view of a door device according to the invention, arranged on a door, together with a side view of a slot assembly according to the invention, when the main spar (not shown in this figure) is in the inactive position. In this embodiment of the door device the first and second main closing elements (3, 4) are substantially L-shaped and each comprise a longer arm (33, 43) and a shorter arm (34, 44), as in the embodiment of FIGS. 1 to 4. The slot assembly comprises a first slot (121) adapted to receive at least part of the longer arm (33) of the first main closing element (3), a second slot (122) adapted to receive at least part of the longer arm (43) of the second main closing element (4) and a third slot (123) adapted to receive at least part of the shorter arm (34) of the first main closing element (3), at least part of the shorter arm (44) of the second main closing element (4) and at least part of the auxiliary closing wedge (111) when the main spar is in the inactive position.

In this embodiment, the door device further comprises a secondary support surface (21) arranged parallel to the main support surface (2). The first main closing element (3) can be seen located between the main support surface (2) and the secondary support surface (21). The main support surface (2) is attached to a surface of the door.

In FIG. 5*a*, the short arm of the first main closing element (3) and the third slot (123) of the slot assembly are shown. It can be observed how the first main closing element (3) comprises first sealing elements (101). The main support surface (2) and the secondary support surface (21) further comprise second sealing elements (102). First and second sealing elements (101, 102) are configured to cooperate with each other when the main spar (not shown in this figure) is in the watertight position, thus providing a seal engagement between the first main closing element (3) and the main (2) and secondary (21) support surfaces.

Further, the third slot (123) of the slot assembly comprises third sealing elements (103), adapted to interact with the first main closing element (3), providing a watertight seal when the main spar (not shown in this figure) is in the watertight position.

In one embodiment, first sealing elements (101) are arranged along the zones of the main closing elements (3, 4) and of the auxiliary closing wedge (111) which are intended to contact the main (2) and/or the secondary (21) support surface when the main spar (10) is in the watertight position. In turn, second sealing elements (102) are arranged along the zones of the main (2) and/or the secondary (21) support surface where the first sealing elements (101) are intended to contact.

Figure 5B:
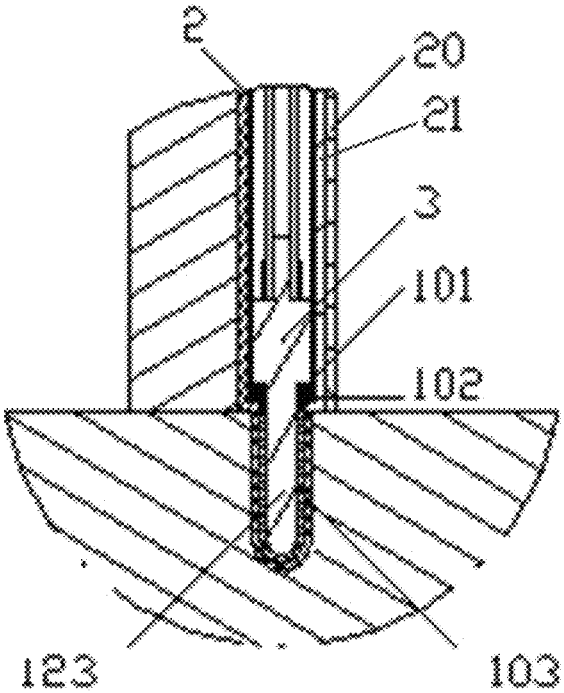

FIG. 5*b* shows the elements of the FIG. 5*a*, but when the main spar (10) is in the watertight position. As in this figure the first main closing element (3) is inside the third slot, this third slot is not seen. In FIG. 5*b* the first sealing elements (101) abut the second sealing elements (102). Both first and second sealing elements (101, 102) are depicted in black in this figure.

In the embodiments described above, as the main spar (10), the main closing elements (3, 4), the first connecting elements (5), the second connecting elements (6), the third connecting elements (7), the fourth connecting elements (8), the transversal element (11) and the secondary guiding elements (93, 94) are mechanically inter-related, the movement of one of them causes the movement of the rest of pieces: although the movement of the main spar (10) is the most common way of initiating the movement of the door device (1) from the inactive position to the watertight position, it is possible to initiate the movement by actuating on either the main closing elements (3, 4) or the connecting elements (5, 6, 7, 8), or the transversal element (11). Furthermore, the movement of all these elements is reversible, i.e., when the main spar (10) moves back from the watertight position to the inactive position, the rest of the pieces return to their inactive positions too.

Figure 5C:
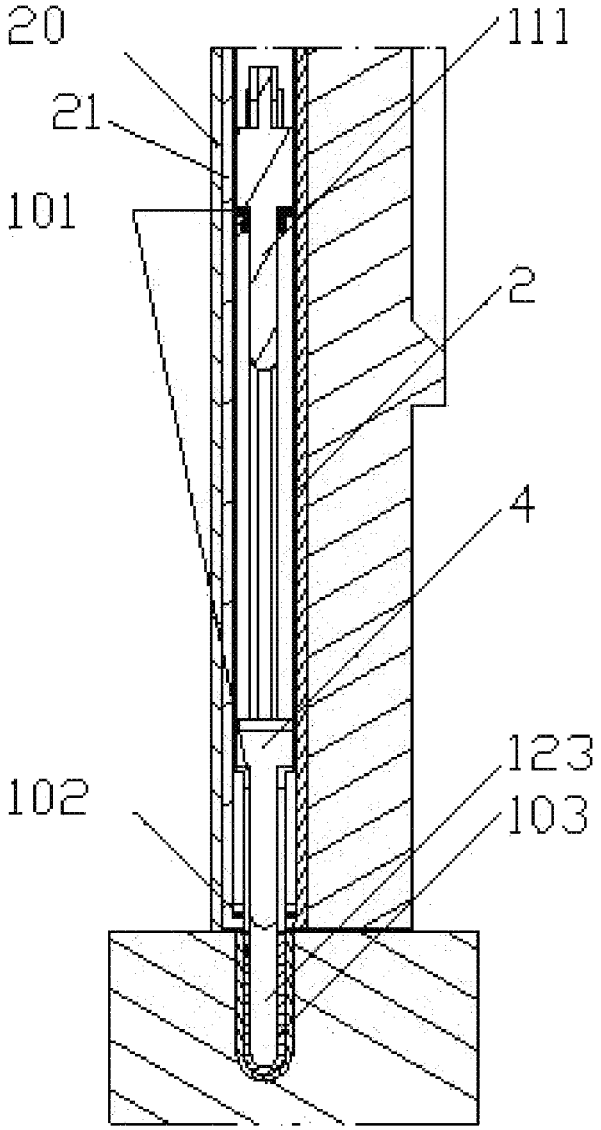
FIG. 5*c* This figure shows a side sectional view of different details of the door device and a slot assembly according to an embodiment of the invention in the inactive position.

FIG. 5*c* shows a view similar to that of FIG. 5*a*. In this case, the second main closing element (4) and the auxiliary closing wedge (111) are shown, which present a similar configuration, with first sealing elements (101). The second sealing means (102) of the main (2) and secondary (21) support surface also cooperate with the first sealing elements (101) of the second main closing element (4) and the auxiliary closing wedge (111). Further, the third slot (123), suitable for receiving the shorter arm of each of the main closing elements (3, 4), and the auxiliary closing wedge (111) also comprises third sealing elements (103), adapted to interact with the shorter arm of each of the main closing elements (3, 4), and the auxiliary closing wedge (111).

As previously mentioned, in these FIGS. 5*a*-5*c*, a secondary support surface (21) is also shown, comprising second sealing elements (102) in the same way as the main support surface (2). In other embodiments, the door device includes only the main support surface and the door itself to which the door device (1) is attached is used as a secondary support surface. In the embodiments shown in FIGS. 5*a*-5*c* an auxiliary cover (20) is also present covering the visible side of the door device for decorative purposes.

Figure 5D:
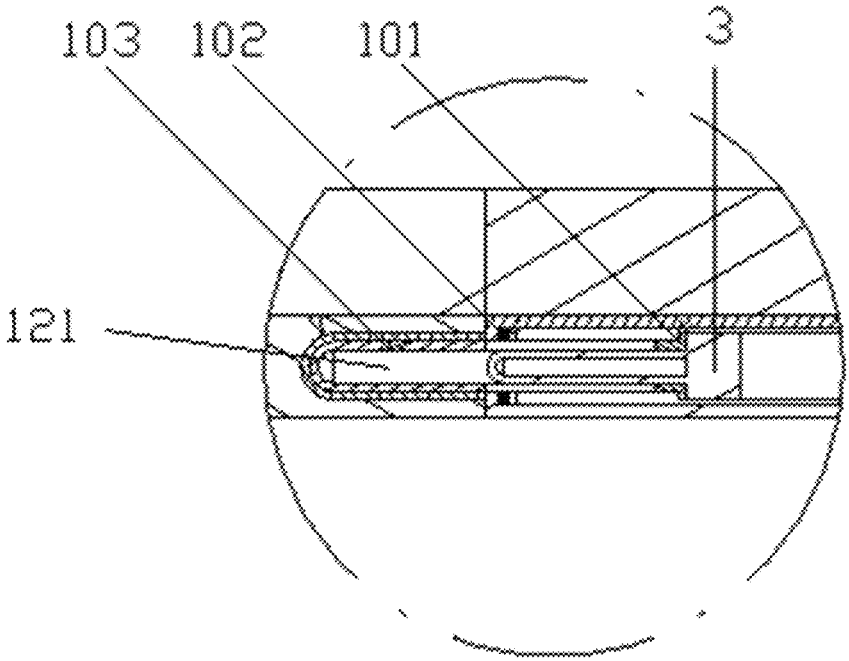
FIGS. 5*d*-5*e* These figures show a plan sectional view of different details of the door device and a slot assembly according to an embodiment of the invention, in the inactive positions.
Figure 5E:
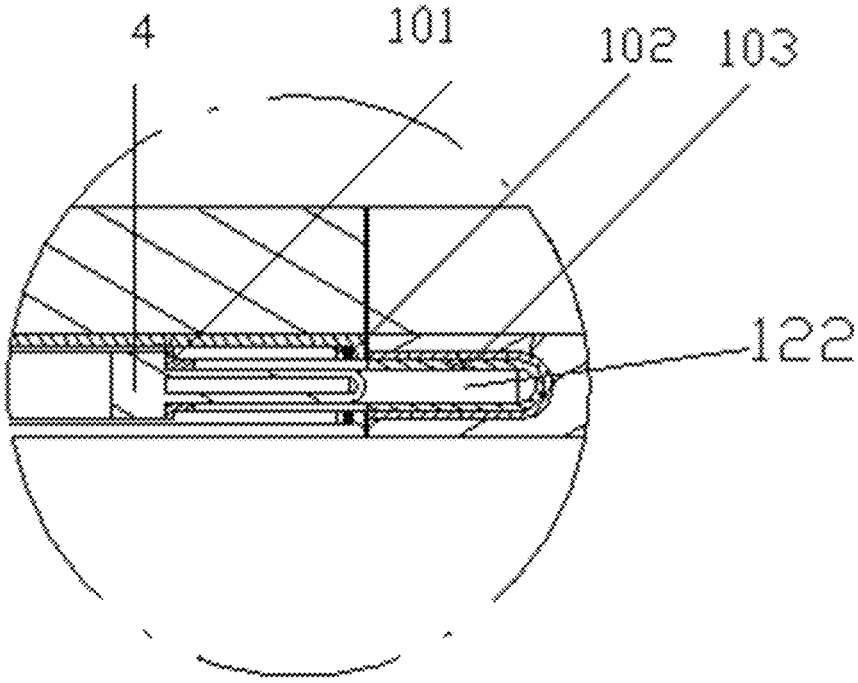

FIGS. 5*d* and 5*e* show a side view of the longer arms of the main closing elements (3, 4) of an embodiment of the invention in their inactive positions, as well as the first (121) and second (122) slots of the slot assembly adapted to receive at least partially the main closing elements (3, 4).

FIG. 5*d* shows the longer arm of the first main closing element (3) comprising first sealing elements (101). The main support surface (2) further comprises second sealing elements (102). First and second sealing elements (101, 102) are configured to cooperate with each other when the main spar (not shown in this figure) is in the watertight position, thus providing a seal engagement between the first main closing element (3) and the main support surface.

Further, the first slot (121) of the slot assembly comprises third sealing elements (103), adapted to interact with the first main closing element (3), providing a watertight seal when the main spar (not shown in this figure) is in the watertight position.

FIG. 5*e* shows the longer arm of the second main closing element (4) comprising first sealing elements (101). The main support surface further comprises second sealing elements (102). First and second sealing elements (101, 102) are configured to cooperate with each other when the main spar (not shown in this figure) is in the watertight position, thus providing a seal engagement between the first main closing element (3) and the main support surface.

Further, the second slot (122) of the slot assembly comprises third sealing elements (103), adapted to interact with the second main closing element (4), providing a watertight seal when the main spar (not shown in this figure) is in the watertight position.

Figure 6A:
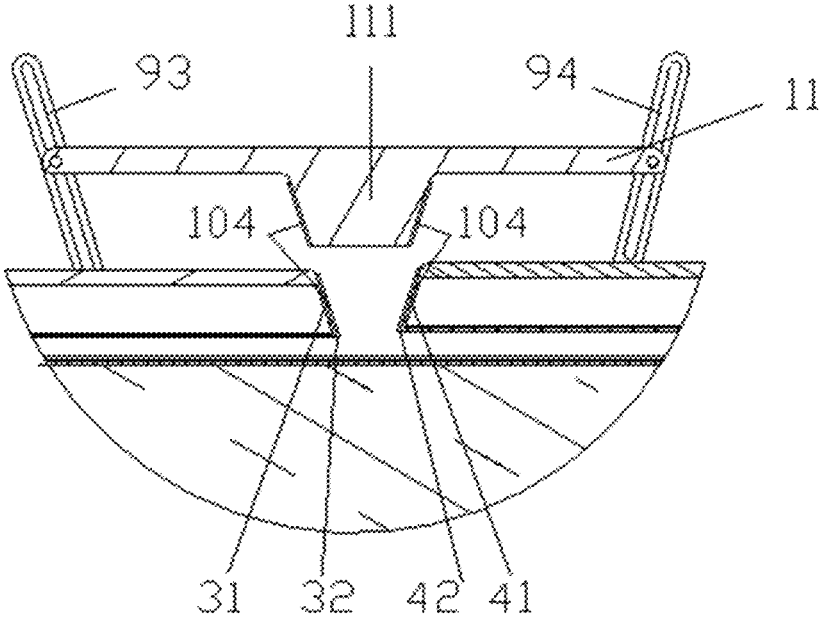
FIGS. 6*a*-6*b* These figures show details of an elevation view of a door device according to the invention.
Figure 6B:
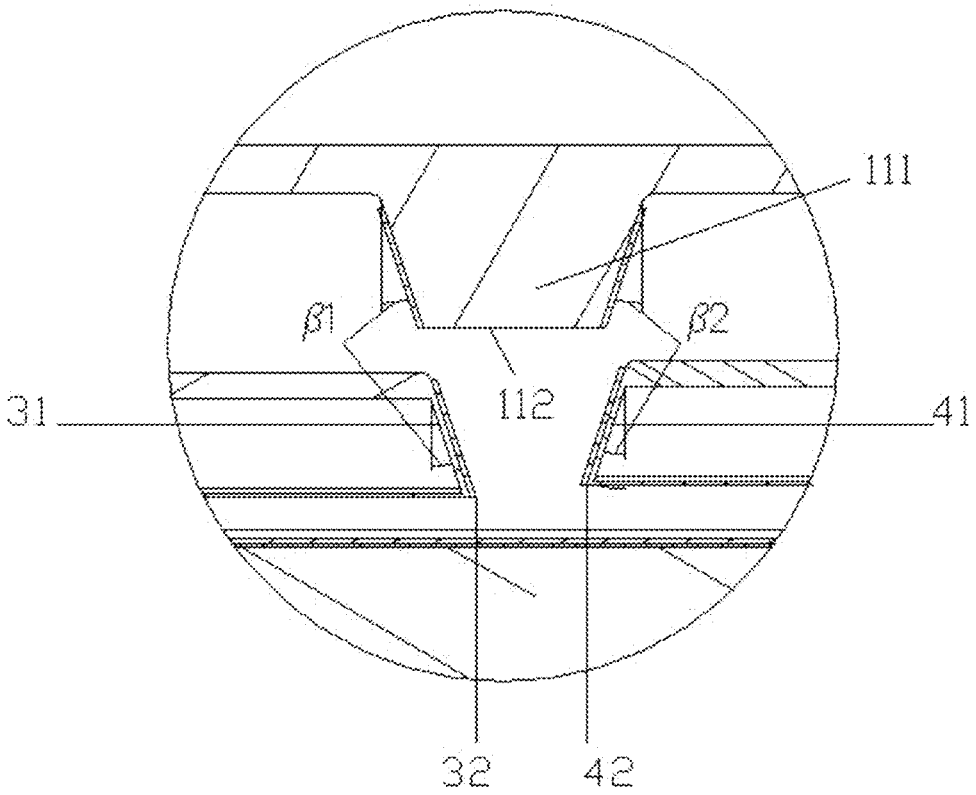

FIG. 6*a* shows a different detail of a door device (1) according to an embodiment of the invention. In this figure, fourth sealing means (104) are shown, comprised in the wedged ends (31, 41) of the first and second main closing elements (3, 4) and in the auxiliary closing wedge (111). These fourth sealing means (104) are intended to cooperate between them when the main spar (10) is in the watertight position.

In one embodiment, all sealing elements (101, 102, 103, 104) are made of a resilient material like rubber, so that they may be pressed against each other, being thus deformed and providing said watertight seal.

Figure 7:
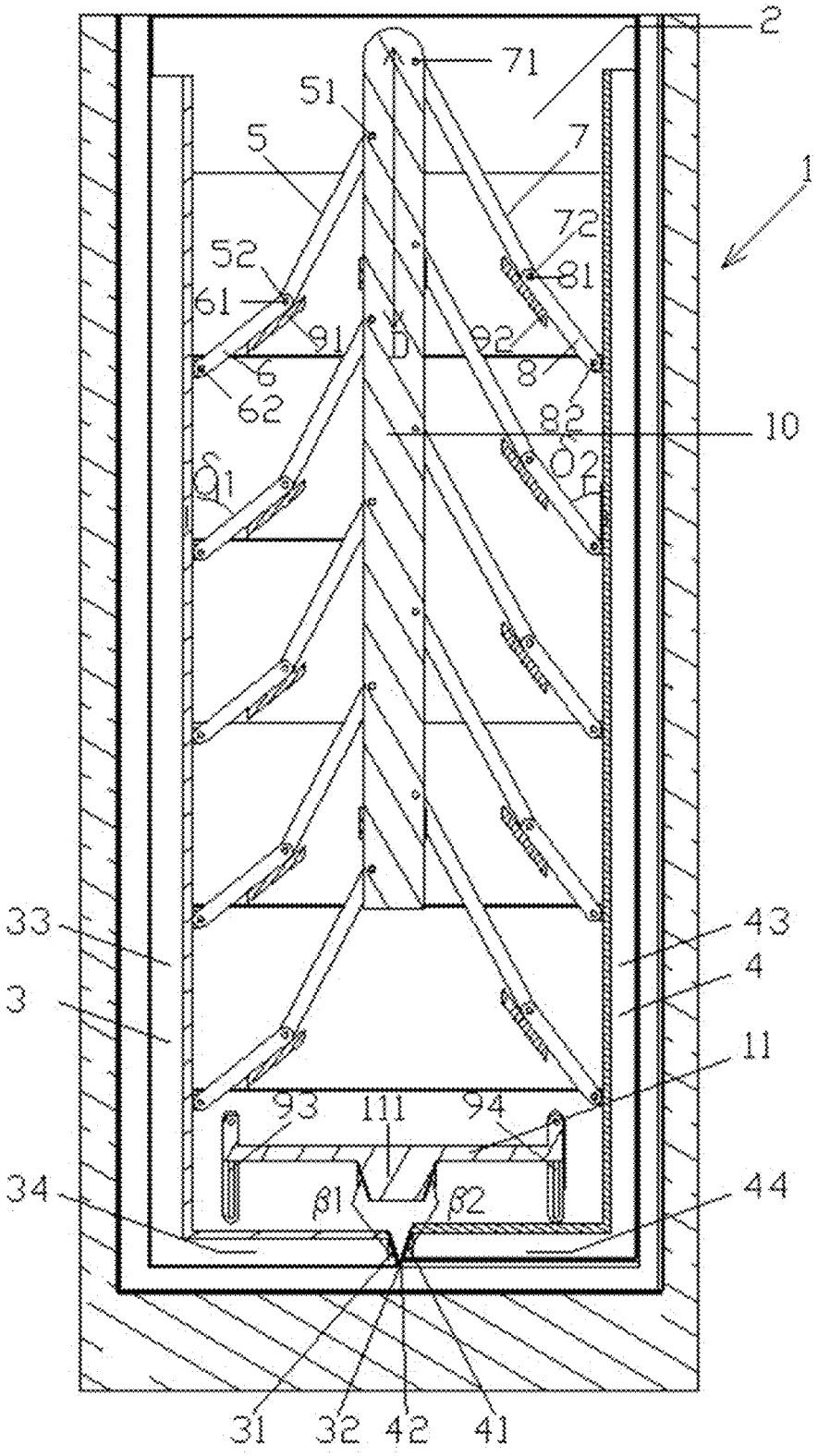
FIG. 7 This figure shows an elevation view of a door device according to a second embodiment of the invention, in an inactive position.

FIG. 7 shows another embodiment of a door device (1) according to the invention. In this embodiment, the secondary guiding elements (93, 94) are attached to the main support surface (2), and first and second secondary guiding angles ($\alpha 1$, $\alpha 2$)=0. In this case, the movement of the main closing elements (3, 4) does not provoke a movement in the transversal element (11), but the transversal element (11) is moved once the main spar (10) is in its watertight position.

In this embodiment, as said movements are not related, the door device (1) further comprises a first handling element (not shown) adapted to move the transversal element (11) to a position wherein the auxiliary closing wedge (111) abuts both the wedged end of the first main closing element (3) and the wedged end of the second main closing element (4).

Figure 8:
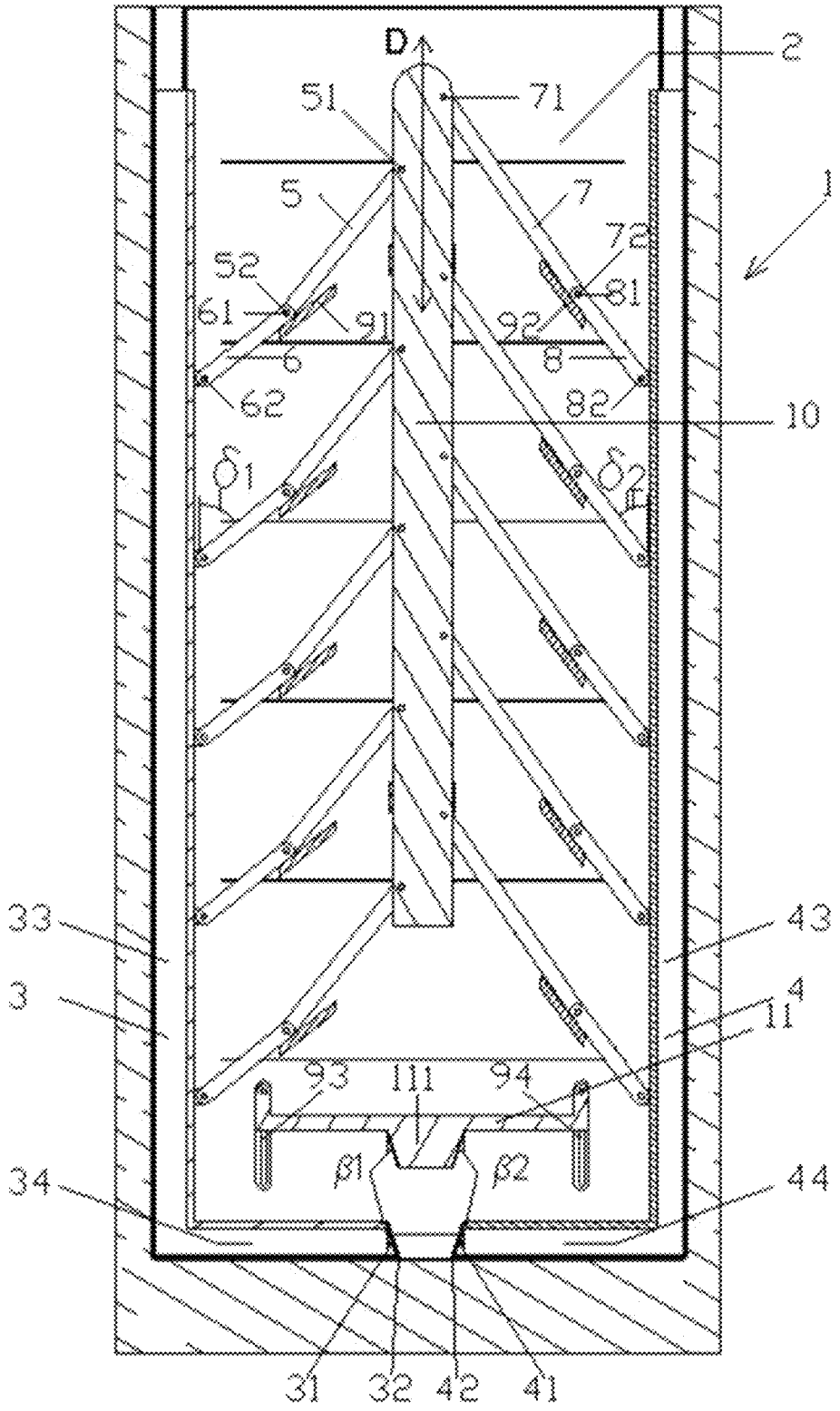
FIG. 8 This figure shows an elevation view of a door device according to a second embodiment of the invention, in an intermediate position between the inactive position and the watertight position.
Figure 9:
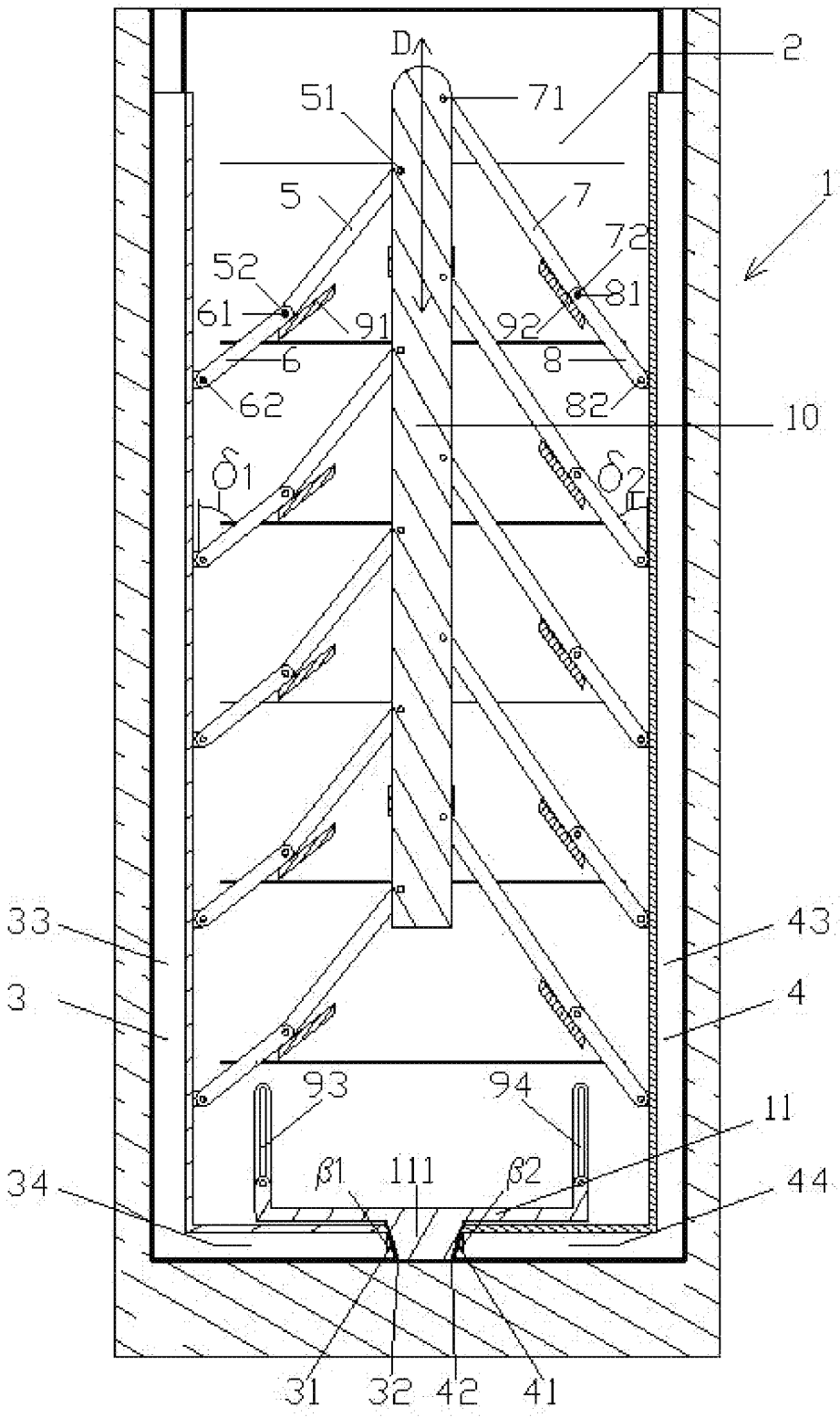
FIG. 9 This figure shows an elevation view of a door device according to a second embodiment of the invention, in the watertight position.

FIG. 8 shows this embodiment of the door device (1) in a position which is intermediate between the inactive position and the watertight position. In the intermediate position shown in FIG. 8 the first main closing element (3) and the second main closing element (4) are placed in their final watertight positions, while the transversal element (11) is still in its inactive position. FIG. 9, in turn, shows this embodiment of the door device (1) in the watertight position, where the transversal element (11) is in its watertight position, with the auxiliary closing wedge (111) placed between the wedged end of the first main closing element (3) and the wedged end of the second main closing element (4), which are also in their watertight positions.

The invention claimed is:

1. A door device (1) adapted to provide a watertight condition against an external surface, the door device (1) comprising:

a main support surface (2), defining a main area (2*a*);

a main spar (10) adapted to be moved in an activation direction (D) between an inactive position and a watertight position;

a first main closing element (3) comprising a wedged end (31) with a first closure point (32) located in an acute vertex of said wedged end (31), a second main closing element (4) comprising a wedged end (41) with a second closure point (42) located in an acute vertex of said wedged end (41), said first and second closure points (32, 42) defining a closure gap, which is the distance between said first and second closure points (32, 42);

first connecting elements (5), each having a first end (51) and a second end (52), each first connecting element (5) being hingeably attached in the first end (51) to the main spar (10);

second connecting elements (6), each having a first end (61) and a second end (62), each second connecting element (6) being hingeably attached in the first end (61) to the second end (52) of one first connecting element (5) and being hingeably attached in the second end (62) to the first main closing element (3);

third connecting elements (7), each having a first end (71) and a second end (72), each third connecting element (7) being hingeably attached in the first end (71) to the main spar (10);

fourth connecting elements (8), each having a first end (81) and a second end (82), each fourth connecting element (8) being hingeably attached in the first end (81) to the second end (72) of one third connecting element (7) and being hingeably attached in the second end (82) to the second main closing element (4);

a plurality of primary guiding elements (91, 92), each one being attached to the main support surface (2), in such a way that each one of the second connecting elements (6) is in contact with one of a first group of primary guiding elements (91) which are oriented forming a first primary guiding angle (δ1) with respect to the activation direction (D) in clockwise direction, and each one of the fourth connecting elements (8) is in contact with one of a second group of primary guiding elements (92), which are oriented forming a second primary guiding angle (δ2) with respect to the activation direction (D) in counterclockwise direction;

a transversal element (11) comprising an auxiliary closing wedge (111) with sides, two of the sides forming first and second wedge angles (β1, β2) respectively with respect to the activation direction (D) and other side being the ground side;

a first secondary guiding element (93), and a second secondary guiding element (94), the secondary guiding elements (93, 94) being adapted to guide the tranversal element (11), the tangent to each point of the first secondary guiding element (93) forming a first secondary guiding angle (α1) with respect to the activation direction (D) in counterclockwise direction and the tangent to each point of the second secondary guiding element (94) forming a second secondary guiding angle (α2) with respect to the activation direction (D) in clockwise direction;

wherein in the inactive position of the main spar (10), the first and second main closing elements (3, 4) are located within the main area (2*a*);

along the movement of the main spar (10) between the inactive position and the watertight position, the movement of each second connecting element (6) is limited by one of the first group of primary guiding elements (91) to the direction of said primary guiding element (91) and the movement of each fourth connecting element (8) is limited by one of the second group of primary guiding elements (92) to the direction of said primary guiding element (92), making the first and second main closing elements (3, 4) exit the main area (2*a*);

when the main spar (10) is in the watertight position, the closure gap is equal to the length of the ground side of the auxiliary closing wedge (111);

the secondary guiding elements (93, 94) are adapted to guide the transversal element (11) so that the auxiliary closing wedge (111) exits the main area to abut both the wedged end (31) of the first main closing element (3) which forms a first closing angle with respect to the activation direction (D) which is equal to the first wedge angle (β1), and the wedged end (41) of the second main closing element (4) which forms a second closing angle with respect to the activation direction (D) which is equal to the second wedge angle (β2); and the first secondary guiding angle (α1) is lower than, or equal to, the first wedge angle (β1) and the second secondary guiding angle (α2) is lower than, or equal to, the second wedge angle (β2).

2. The door device (1) according to claim 1, wherein the first primary guiding angle (δ1) is equal to the second primary guiding angle (82), the first wedge angle (β1) is equal to the second wedge angle (β2) and the first secondary guiding angle (α1) is equal to the second secondary guiding angle (α2).

3. The door device (1) according to claim 1, wherein the first secondary guiding element (93) is attached to the first main closing element (3), and the second secondary guiding element (94) is attached to the second main closing element (4), so that the secondary guiding elements (93, 94) guide the transversal element (11) when the main spar (10) moves between the inactive position and the watertight position.

4. The door device (1) according to claim 1, wherein the secondary guiding elements (93, 94) are attached to the main support surface (2), the first secondary guiding angle (α1) and the second secondary guiding angle (α2) equal 0 and the door device (1) further comprises a first handling element adapted to move the transversal element (11) to a position wherein the auxiliary closing wedge (111) abuts both the wedged end of the first main closing element (3) and the wedged end of the second main closing element (4).

5. The door device (1) according to claim 1, further comprising a second handling element adapted to move the main spar (10) between the inactive position and the watertight position.

6. The door device (1) according to claim 1, wherein the first and second main closing elements (3, 4) and at least part of the auxiliary closing wedge (111) are made of a waterproof material.

7. The door device (1) according to claim 1, wherein the first and second main closing elements (3, 4) are substantially L-shaped, each comprising a longer arm (33, 43) and a shorter arm (34, 44); the longer arms (33, 43) being arranged substantially parallel to each other and the shorter arms (34, 44) being oriented towards each other.

8. The door device (1) according to claim 7, wherein the main closing elements (3, 4) are placed such that when the main spar (10) is in the inactive position, the longer arms (33, 43) and the shorter arms (34, 44) are located in the edges of the main area (2*a*), which is rectangular.

9. The door device (1) according to claim 1, wherein the main closing elements (3, 4) and the auxiliary closing wedge (111) comprise sealing elements (101, 104).

10. The door device (1) according to claim 1, further comprising a secondary support surface (21) substantially parallel to the main support surface (2), wherein the main spar (10), the first (5), second (6), third (7) and fourth (8) connecting elements, the primary guiding elements (91, 92) and the first (93) and second (94) secondary guiding elements are placed between the main support surface (2) and the secondary support surface (21).

11. A door comprising a door device (1) according to claim 1.

12. A watertight system comprising a door according to claim 11 and further comprising a slot assembly for providing watertightness, the slot assembly being adapted to receive at least partially the first and second main closing elements (3, 4) and the auxiliary closing wedge (111) of the door device (1).

13. A watertight system comprising a door device (1) according to claim 1 and further comprising a slot assembly for providing watertightness, the slot assembly being adapted to receive at least partially the first and second main closing elements (3, 4) and the auxiliary closing wedge (111) of the door device (1).

14. A watertight system according to claim 13, wherein the first and second main closing elements (3, 4) of the door device are substantially L-shaped, each comprising a longer arm (33, 43) and a shorter arm (34, 44); the longer arms (33, 43) being arranged substantially parallel to each other and the shorter arms (34, 44) being oriented towards each other and wherein the slot assembly comprises three slots (121, 122, 123), the first slot (121) being adapted to receive at least part of the longer arm (33) of one of the main closing elements (3), the second slot (122) being adapted to receive at least part of the longer arm (43) of other of the main closing elements (4) and the third slot (123) being adapted to receive at least part of the shorter arm (34) of one of the main closing elements (3), at least part of the shorter arm (44) of other of the main closing elements (4) and at least part of the auxiliary closing wedge (111).

15. The watertight system according to claim 13, wherein the slot assembly is adapted to receive the first and second main closing elements (3, 4) and the auxiliary closing wedge (111) of the door device (1), the slot assembly comprising third sealing elements (102) arranged to contact the main closing elements (3, 4) and the closing wedge (111) of the door device (1) when the main spar (10) is in its watertight position.

16. A watertight system according to claim 13, wherein the first and second main closing elements (3, 4) of the door device are substantially L-shaped, each comprising a longer arm (33, 43) and a shorter arm (34, 44); the longer arms (33, 43) being arranged substantially parallel to each other and the shorter arms (34, 44) being oriented towards each other and the main closing elements (3, 4) are placed such that when the main spar (10) is in the inactive position, the longer arms (33, 43) and the shorter arms (34, 44) are located in the edges of the main area (2*a*), which is rectangular, and wherein the slot assembly comprises three slots (121, 122, 123), the first slot (121) being adapted to receive at least part of the longer arm (33) of one of the main closing elements (3), the second slot (122) being adapted to receive at least part of the longer arm (43) of other of the main closing elements (4) and the third slot (123) being adapted to receive at least part of the shorter arm (34) of one of the main closing elements (3), at least part of the shorter arm (44) of other of the main closing elements (4) and at least part of the auxiliary closing wedge (111).

17. A method for providing a watertight door, comprising the steps of:

providing a door device (1) according to claim 1, and attaching the door device (1) to a door.

* * * * *